US011118136B2

(12) United States Patent
Piorkowski

(10) Patent No.: US 11,118,136 B2
(45) Date of Patent: Sep. 14, 2021

(54) DETERGENT COMPOSITIONS CONTAINING A SURFACTANT SYSTEM INCLUDING A NONIONIC AND AN IONIC SURFACTANT

(71) Applicant: Henkel IP & Holding GmbH, Duesseldorf (DE)

(72) Inventor: Daniel T. Piorkowski, Fairfield, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 0 days.

(21) Appl. No.: 16/001,316

(22) Filed: Jun. 6, 2018

(65) Prior Publication Data

US 2019/0376005 A1 Dec. 12, 2019

(51) Int. Cl.

| | |
|---|---|
| ***C11D 1/831*** | (2006.01) |
| ***C11D 1/14*** | (2006.01) |
| ***C11D 1/22*** | (2006.01) |
| ***C11D 1/722*** | (2006.01) |
| ***C11D 3/00*** | (2006.01) |
| ***C11D 3/386*** | (2006.01) |
| ***C11D 3/39*** | (2006.01) |
| ***C11D 3/42*** | (2006.01) |
| ***C11D 3/43*** | (2006.01) |
| ***C11D 3/48*** | (2006.01) |
| ***C11D 11/00*** | (2006.01) |
| *C11D 17/04* | (2006.01) |
| *C11D 17/08* | (2006.01) |

(52) U.S. Cl.

CPC ..... *C11D 1/831* (2013.01); *C11D 1/146* (2013.01); *C11D 1/22* (2013.01); *C11D 1/722* (2013.01); *C11D 3/001* (2013.01); *C11D 3/0021* (2013.01); *C11D 3/0036* (2013.01); *C11D 3/386* (2013.01); *C11D 3/3905* (2013.01); *C11D 3/42* (2013.01); *C11D 3/43* (2013.01); *C11D 3/48* (2013.01); *C11D 11/0017* (2013.01); *C11D 17/04* (2013.01); *C11D 17/08* (2013.01)

(58) Field of Classification Search

CPC ..... C11D 1/831; C11D 1/146; C11D 17/04
See application file for complete search history.

(56) References Cited

U.S. PATENT DOCUMENTS

| | | | | |
|---|---|---|---|---|
| 2007/0066504 | A1 | 3/2007 | Hsu et al. | |
| 2014/0187466 | A1 | 7/2014 | Lin et al. | |
| 2015/0329807 | A1* | 11/2015 | Naqvi | C11D 3/2041 206/524.7 |
| 2016/0281032 | A1* | 9/2016 | Vockenroth | C11D 1/28 |
| 2017/0009191 | A1 | 1/2017 | Maes et al. | |
| 2017/0029747 | A1 | 2/2017 | Depoot et al. | |
| 2018/0195027 | A1* | 7/2018 | Liu | C11D 17/0039 |
| 2019/0048296 | A1* | 2/2019 | Pirokowski | C11D 17/043 |

FOREIGN PATENT DOCUMENTS

| | | | |
|---|---|---|---|
| EP | 0997521 | A1 | 3/2000 |
| WO | 2007/057085 | A1 | 5/2007 |
| WO | 2007/141120 | A1 | 12/2007 |

OTHER PUBLICATIONS

European Search Report EP 19175855 Completed: Oct. 15, 2019; dated Oct. 21, 2019 6 pages.

* cited by examiner

*Primary Examiner* — Necholus Ogden, Jr.
(74) *Attorney, Agent, or Firm* — Bojuan Deng

(57) ABSTRACT

A wash composition includes a surfactant system, a solvent system, and one or more beneficial compositions. The surfactant system includes a) a linear alkylbenzenesulfonate (LAS), and b) a fatty acid methyl ester ethoxylate (MEE). Optionally, the surfactant system may further include c) an alkyl ether sulfate (AES), and d) a nonionic alcohol ethoxylate (AE). The wash composition may be embodied as a unit dose composition or a heavy-duty liquid. Methods for increasing the effectiveness of fabric cleaning that include using the wash composition are also provided.

19 Claims, No Drawings

DETERGENT COMPOSITIONS CONTAINING A SURFACTANT SYSTEM INCLUDING A NONIONIC AND AN IONIC SURFACTANT

TECHNICAL FIELD

The present disclosure relates to detergent compositions. More particularly, the present disclosure provides detergent compositions containing a nonionic and an ionic surfactant compound that synergistically achieve an improved cleaning efficiency.

BACKGROUND

Detergent formulators are faced with the task of devising products to remove a broad spectrum of soils and stains from fabrics. Chemically and physico-chemically, the varieties of soils and stains range the spectrum from polar soils and inorganic soils, to non-polar soils, to organic soils. Detergent compositions have become more complex as formulators attempt to provide products that handle all types concurrently.

Nonionic surfactants are generally used in laundry detergent compositions for their ability to remove greasy and oily soils. One type of nonionic surfactant used in a wide variety of applications is ethoxylated alcohols. Alcohol ethoxylates (AE) are known for their positive characteristics in household and industrial applications, such as low toxicity, high biodegradability, varying ethoxylation ranges and excellent cleaning performance. Another type of nonionic surfactant is fatty acid methyl ester ethoxylates (MEE). Methyl ester ethoxylates are considered environmentally friendly due to their derivation from plant sources, as well as being biodegradable, all while having excellent cleaning qualities.

Ionic surfactants, in addition to their soil removal benefit, are known as useful additives in laundry detergent compositions for the purpose of providing the laundered fabrics with a static control benefit, a fabric softening benefit, and a sanitization benefit. One type of ionic surfactant is alkyl ether sulfates (AES). AES foams easily in water, and thus is able to remove a wide variety of soils. Another type of ionic surfactant is linear alkylbenzenesulfonates (LAS), which is a water-soluble salt of a linear alkyl benzene sulfonic acid having between 8 and 22 carbon atoms of the linear alkyl group. LAS is beneficial for removing oily and fatty soils, and is widely used in a variety of cleaning compositions.

In the context of a washing composition, such as a laundry detergent, there is of course a maximum amount of surfactants that is typically incorporated into the composition. This is particularly true in unit dose compositions, where volume is limited. For example, alcohol ethoxylate (AE) nonionic surfactants are conventionally limited to about 25% by weight of the overall wash composition. Moreover, AES has an efficiency limit of about 25% by weight about 15% by weight of active component) of the overall wash composition. It is conventionally believed that each of MEE and LAS have limited cleaning efficiency beyond about 5% by weight of the overall wash composition.

Given the foregoing content limitations on the inclusion of surfactants in wash compositions, it is clear that simply adding more of any given surfactant to the wash composition is not a practical solution to improve the wash efficiency of the wash composition. Accordingly, it would be desirable to provide surfactant systems that demonstrate synergistic cleaning efficiencies—that is, combinations of surfactants which, for a given weight percent in the wash composition, exhibit an improved cleaning efficiency over a similar weight of any single constituent of the surfactant system. Furthermore, other desirable features and characteristics will become apparent from the subsequent detailed description and the appended claims, taken in conjunction with the accompanying drawings and the foregoing technical field and background.

BRIEF SUMMARY

It has been surprisingly discovered by the inventors herein that a surfactant system of linear alkylbenzenesulfonates and fatty acid methyl ester ethoxylates, in particular ratios as set forth in greater detail below, exhibits an improved cleaning efficiency (on an equivalent weight percent basis of the surfactant systems in the wash composition) as compared to a surfactant system of one of either linear alkylbenzenesulfonates or fatty acid methyl ester ethoxylates. This synergistic cleaning effect of the inventive system was observed across a range of soil types, and at different washing temperatures. Moreover, the synergistic cleaning effect was further observed with the inclusion of additional surfactants, namely alkyl ether sulfates and nonionic alcohol ethoxylates.

Accordingly, in one exemplary embodiment of the present disclosure, provided is a wash composition that includes a surfactant system, a solvent system, and one or more beneficial compositions. The surfactant system includes a) a linear alkylbenzenesulfonate (LAS), and b) a fatty acid methyl ester ethoxylate (MEE). In some embodiments, the surfactant system may further include c) an alkyl ether sulfate (AES), and d) a nonionic alcohol ethoxylate (AE). In some embodiments, the wash composition may include no surfactant other than the LAS and the MEE. In other embodiments, the wash composition may include no surfactant other than the AES, AE, LAS, and MEE. The wash composition may be embodied in a unit (single) dose composition or as a heavy-duty liquid.

In another exemplary embodiment, a method for increasing the effectiveness of fabric cleaning comprising includes placing the fabrics into an amount of water and forming a wash liquor by adding to the amount of water a wash composition. The wash composition includes a surfactant system, a solvent system, and one or more beneficial compositions. The surfactant system includes a) a linear alkylbenzenesulfonate (LAS), and b) a fatty acid methyl ester ethoxylate (MEE). In some embodiments, the surfactant system may further include c) an alkyl ether sulfate (AES), and d) a nonionic alcohol ethoxylate (AE). The method further includes agitating the fabrics within the wash liquor. The wash composition may be added to the amount of water in the form of a unit (single) dose pack or a heavy-duty liquid.

In further aspects of the present disclosure, the alkyl ether sulfate may be sodium lauryl ether sulfate (SLES), the nonionic alcohol ethoxylate may be a compound according to Formula (B):

$$R_2—(—O—C_2H_4—)_m—OH \quad (B)$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8, the linear alkylbenzenesulfonate may be an alkali metal salt of a $C_{10}$-$C_{16}$ alkyl benzene sulfonic acid, the fatty acid methyl ester ethoxylate has an average unit number of repeating ethylene oxide (EO) units of from about 5 to 30 moles, and the fatty acid methyl ester ethoxylate may be derived from a fatty acid having from 10 to 22 carbons. Moreover, the alkyl ether sulfate may be present in an amount of about 3% to about 35%, based on the total weight of the wash composition, the nonionic alcohol ethoxylate may be present in an amount of about 3% to about 35%, based on the total weight of the wash composition, the linear alkylbenzenesulfonate may be present in an amount of about 1% to about 20%, based on the total weight of the wash composition, and the fatty acid methyl ester ethoxylate may be present in an amount of about 1% to about 40%, based on the total weight of the wash composition.

In further aspects of the present disclosure, a weight ratio of the methyl ester ethoxylate to the linear alkylbenzenesulfonate (MEE:LAS) may be within a range of about 1:5 to about 5:1. In still further aspects of the present disclosure, a weight ratio of the alkyl ether sulfate to the nonionic alcohol ethoxylate to the linear alkylbenzenesulfonate to the fatty acid methyl ester ethoxylate (AES:AE:LAS:MEE) may be within a range of about 25:(12 to 20):(2 to 15):(2 to 15). Moreover, the surfactant system may be present in an amount of about 8% to about 75%, based on the total weight of the wash composition.

In further aspects of the present disclosure, the solvent system may include one or more solvents selected from the group consisting of: polyols, ionic liquids, glycol ethers, ethylene oxide/propylene oxide (EO/PO) block copolymers, polyethylene glycol, and water. Moreover, the solvent system may be present in an amount of about 15% to about 92%, based on the total weight of the wash composition.

In still further aspects of the present disclosure, the one or more beneficial compositions may be selected from the group consisting of: an enzyme, a peroxy compound, a bleach activator, an anti-redeposition agent, a neutralizer, an optical brightener, a foam inhibitor, a chelator, a bittering agent, a dye transfer inhibitor, a soil release agent, a water softener, an electrolyte, a pH regulator, a graying inhibitor, an anti-crease component, a bleach agent, a colorant, a scent, a processing aid, an antimicrobial agent, and a preservative.

This brief summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

DETAILED DESCRIPTION

The following detailed description is merely exemplary in nature and is not intended to limit the single dose pack, or the method for producing or using the same. Furthermore, there is no intention to be bound by any theory presented in the preceding background or the following detailed description.

The following description provides specific details, such as materials and dimensions, to provide a thorough understanding of the present disclosure. The skilled artisan, however, will appreciate that the present disclosure can be practiced without employing these specific details. Indeed, the present disclosure can be practiced in conjunction with processing, manufacturing, or fabricating techniques conventionally used in the detergent industry. Moreover, the processes below describe only steps, rather than a complete process flow, for manufacturing the wash compositions containing the inventive surfactant system according to the present disclosure.

As used herein, "a," "an," or "the" means one or more unless otherwise specified. The term "or" can be conjunctive or disjunctive. Open terms such as "include," "including," "contain," "containing" and the like mean "comprising." The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated. As used herein, the "%" described in the present disclosure refers to the weight percentage unless otherwise indicated. As used herein, the phrase "substantially free of" means that a composition contains little no specified ingredient/component, such as less than about 1 wt %, 0.5 wt %, or 0.1 wt %, or below the detectable level of the specified ingredient. Unless stated otherwise, molecular weight of a polymer refers to weight average molecular weight.

In one aspect, the present disclosure provides a wash composition that includes a synergistic surfactant system including linear alkylbenzenesulfonates and fatty acid methyl ester ethoxylates. Optionally, the surfactant system may further include alkyl ether sulfates and nonionic alcohol ethoxylates. The wash composition of the present disclosure may be formulated into a single (unit) dose pack, or into a heavy-duty liquid. A single dose pack is formed by encapsulating a wash composition within a container, where the container is composed of a film. In some embodiments, the film forms one half or more of the container, where the container may also include dyes, print, or other components in some embodiments. The film is water soluble such that the film will completely dissolve when an exterior of the film is exposed to water, such as in a washing machine typically used for laundry. When the film dissolves, the container is ruptured and the contents are released. A heavy-duty liquid is poured directly into the wash water, or is placed in a detergent compartment of the washing machine, which then dispenses the heavy-duty liquid into the wash water at an appropriate time during the wash cycle.

In some embodiments, regardless of its formulation into a unit dose pack or a heavy-duty liquid, the wash composition of the present disclosure includes the above-mentioned four component surfactant system, a solvent system, and one or more beneficial compositions. The one or more beneficial compositions may include, for example, a fragrance composition, a color care agent, an anti-redeposition agent, or a softening agent, among others as will be discussed in greater detail below.

As mentioned above, the wash compositions in accordance with the present disclosure include a surfactant system that exhibits synergistic effects in terms of cleaning efficiency.

In accordance with the present disclosure, one component of the surfactant system is a linear alkylbenzene sulfonic acid or a salt thereof, alkyl ethoxylated sulfate, alkyl propoxy sulfate, alkyl sulfate, or a mixture thereof. Linear alkylbenzenesulfonate (LAS) is a water soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS includes an alkali metal salt of $C_{10}$-$C_{16}$ alkyl benzene sulfonic acids, such as $C_{11}$-$C_{14}$ alkyl benzene sulfonic acids.

The LAS may be present in the wash composition in an amount ranging from about 1% to about 20%, or about 3% to about 20%, or about 1% to about 15%, or about 5% to about 20%, or about 1% to about 10%, based on the total weight of the wash composition. In other embodiments, the LAS may be present in the wash composition in an amount ranging from about 1% to about 3%, or about 3% to about 5%, or about 5% to about 8%, or about 8% to about 10%, or about 10% to about 15%, or about 15% to about 20%, based on the total weight of the wash composition.

In accordance with the present disclosure, another component of the surfactant system is a methyl ester ethoxylate (MEE). Suitable MEE in accordance with the present disclosure has an average unit number of the repeating ethylene oxide (EO) unit of from about 5 to 30 moles, preferably from 8 to 25 moles, more preferably from 10 to 18 moles, per mole of the methyl ester ethoxylate, wherein the fatty acid contains from 10 to 22 carbons, preferably from 15 to 20 carbons, and more preferably from 16 to 18 carbons.

The MEE may be present in the wash composition in an amount ranging from about 1% to about 40%, or about 1% to about 35%, or about 1% to about 30%, or about 1% to about 25%, or about 3% to about 40%, or about 3% to about 35%, or about 3% to about 30%, or about 3% to about 25%, or about 3% to about 20%, or about 1% to about 15%, or about 5% to about 20%, or about 1% to about 10%, based on the total weight of the wash composition. In other embodiments, the MEE may be present in the wash composition in an amount ranging from about 1% to about 3%, or about 3% to about 5%, or about 5% to about 8%, or about 8% to about 10%, or about 10% to about 15%, or about 15% to about 20%, based on the total weight of the wash composition.

In accordance with the present disclosure, a first (1') optional component of the surfactant system is a polyethoxylated alcohol sulfate, such as those sold under the trade name CALFOAM® 303 (Pilot Chemical Company, California). Such materials, also known as alkyl ether sulfates (AES) or alkyl polyethoxylate sulfates, are those which correspond to the following formula (A):

$$R'—O—(C2H4O)n\text{-}SO3M' \quad (A)$$

wherein R' is a C8-C20 alkyl group, n is from 1 to 20, and M' is a salt-forming cation, preferably, R' is C10-C18 alkyl, n is from 1 to 15, and M' is sodium, potassium, ammonium, alkylammonium, or alkanolammonium. In another embodiment, R' is a C12-C16 alkyl, n is from 1 to 6 and M' is sodium. In another embodiment, the alkyl ether sulfate is sodium lauryl ether sulfate (SLES).

The AES, if included, may be present in the wash composition in an amount ranging from about 3% to about 35%, or about 10% to about 35%, or about 5% to about 30%, or about 15% to about 35%, or about 5% to about 25%, or about 20% to about 30%, based on the total weight of the wash composition. In other embodiments, the AES may be present in the wash composition in an amount ranging from about 5% to about 10%, or about 10% to about 15%, or about 15% to about 20%, or about 20% to about 25%, or about 25% to about 30%, or about 30% to about 35%, based on the total weight of the wash composition.

In accordance with the present disclosure, another ($2^{nd}$) optional component of the surfactant system is a nonionic alcohol ethoxylate (AE). The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol. Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (B):

$$R_2—(—O—C_2H_4—)_m—OH \quad (B)$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8. The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols. One suitable AE is Tomadol® 25-7 (available from Air Product). Other suitable AEs include Genapol® $C_{200}$ (available from Clariant), which is a coco alcohol having an average degree of ethoxylation of 20.

The AE, if included, may be present in the wash composition in an amount ranging from about 3% to about 35%, or about 10% to about 35%, or about 5% to about 30%, or about 15% to about 35%, or about 5% to about 25%, or about 20% to about 30%, based on the total weight of the wash composition. In other embodiments, the AE may be present in the wash composition in an amount ranging from about 5% to about 10%, or about 10% to about 15%, or about 15% to about 20%, or about 20% to about 25%, or about 25% to about 30%, or about 30% to about 35%, based on the total weight of the wash composition.

The first and second optional surfactants are not required for the practice of the present disclosure. As such, the AE may be included in some embodiments, but not others. Likewise, the AES may be include in some embodiments, but not others. There is no requirement that the AE and the AES be included together in any embodiment; it is merely optional.

The individual components of the surfactant system of the present disclosure may be provided at particular ratios with respect to one another, represented as a weight ratio of: MEE:LAS, given as about 1:5 to about 5:1. In the embodiments where AE and/or AES are included, the ratio may be stated as AE:AES:LAS:MEE, wherein, in one embodiment, suitable ratios fall within the following range: about 25:(12 to 20):(2 to 15):(2 to 15). In another embodiment, suitable ratios fall within the following range: about 25:(14 to 18):(4 to 12):(4 to 12). In another embodiment, suitable ratios fall within the following range: about 25:16:(5 to 10):(5 to 10). Exemplary ratios include about 25:16:5:5, about 25:16:5:10, and about 25:16:10:5.

Optionally, the surfactant system of the present disclosure may additionally include a fatty acid. Suitable fatty acid may be any fatty acid having formula: R3-C(O)OH, wherein R3 is a C5-C21 linear or branched aliphatic group. Preferably, the R3 is a C13-C21 linear or branched aliphatic group. In some embodiments, the fatty acid is hexanoic acid, heptanoic acid, octanoic acid, nonanoic acid, capric acid, undecanoic acid, dodecanoic acid (lauric acid), tridecanoic acid, myristic acid, pentadecanoic acid, palmitic acid, heptadecanoic acid, stearic acid, nonadecanoic acid, eicosanoic acid, heneicosanoic acid, docosanoic acid, myristoleic acid, palmitoleic acid, sapienic acid, oleic acid, elaidic acid, vaccenic acid, linoleic acid, linoelaidic acid, arachidonic acid, eicosapentaenoic acid, erucic acid, docosahexaenoic acid, or a mixture thereof. In some embodiments, the fatty acid is dodecanoic acid (also known as coconut fatty acid).

In some embodiments, the surfactant system of the present disclosure contains from about 1 to about 20 wt %, from about 1 to about 15 wt %, from about 1 to about 10 wt %, from about 1 to about 6 wt %, or from about 1 to 4 wt % fatty acid, based on the total weight the wash composition. In some embodiments, the surfactant system of the present disclosure contains from about 4 wt % of fatty acid based on the total weight the wash composition.

In its entirety, the surfactant system may compose about 8% to about 75%, or about 35% to about 75%, or about 25% to about 65%, or about 45% to about 75%, or about 25% to about 55% of the total weight of the wash composition. In other embodiment, the surfactant system may compose about 25% to about 35%, or about 35% to about 45%, or about 45% to about 55%, or about 55% to about 65%, or about 65% to about 75% of the total weight of the wash composition.

As initially noted above, the wash composition also includes a solvent system. The wash composition may include from about 15% to about 92%, preferably from about 25% to about 70%, and more preferably from about 30% to about 65% of all of the solvents in a solvent system, based on the total weight of the wash composition. In some embodiments, the wash composition includes from about 15% to about 20%, from about 20% to about 25%, from about 25% to about 30%, from about 30% to about 35%, from about 35% to about 40%, from about 40% to about 45%, from about 45% to about 50%, from about 50% to about 55%, from about 55% to about 60%, from about 60% to about 65%, from about 65% to about 70%, and from about 70% to about 75% all of the solvents, based on the total weight of the wash composition. The solvents in the solvent system include water and at least one non-aqueous solvent. Suitable non-aqueous solvents for the solvent system may include polyols, ionic liquids, glycol ethers, EO/PO block copolymers, polyethylene glycol, and mixtures thereof. The non-aqueous solvents should be miscible with water, in particularly in the presence of surfactants. Such non-aqueous solvents often, if not all, have a hydroxyl functional group.

The wash composition may include from about 5% to about 60%, preferably from about 10% to about 50%, and more preferably from about 15% to about 35% of nonaqueous solvents, based on the total weight of the wash composition. In some embodiments, the wash composition includes from about 5% to about 10%, from about 10% to about 20%, from about 20% to about 30%, from about 30% to about 40%, from about 40% to about 50%, and from about 50% to about 60% by weight of non-aqueous solvents, based on the total weight of the wash composition.

By the term "polyol", it refers to polyhydric alcohol, which may be a linear or branched alcohol with two or more hydroxyl groups, wherein it has no more than 9 aliphatic carbon chain. Preferably, the polyol includes 3 to 8 carbon chain. More preferably, the polyol includes 3 to 6 carbon chain. The molecular weight is typically less than 500 g/mol, such as less than 400 g/mol or less than 300 g/mol. Examples of suitable polyols include, but not limited to, propylene glycol, butylene glycol, pentylene glycol, hexylene glycol, heptylene glycol, octylene glycol, 2-methyl-1,3-propanediol, xylitol, sorbitol, mannitol, diethylene glycol, triethylene glycol, glycerol, erythritol, dulcitol, inositol, and adonitol. The wash compositions of the present disclosure may contain about 1% to about 40% of one or more polyols, preferably from about 5% to about 30%, and more preferably from about 8% to about 20%, by weight of the entire wash composition.

In some embodiments, the solvent system includes propylene glycol and glycerin as non-aqueous solvents. Propylene glycol and glycerin are preferably in an amount of from about 10% to about 30%, more preferably from about 15% to about 25%, by weight of the entire wash composition. In some embodiments, the solvent system includes less propylene glycol than glycerin by weight. In some embodiments, the solvent system includes more propylene glycol than glycerin by weight. In other embodiments, the solvent system includes propylene glycol and glycerin in about 1:1 ratio. In some embodiments, the polyols are present at about 1 to 5 times, preferably about 2 to 4 times, and more preferably about 2 times by weight of any other non-aqueous solvents.

In some embodiments, the solvent system includes polyethylene glycol. As conventionally used in the art, the use of polyethylene glycol (PEG) alone, not followed by a number, refers to PEG with all possible Mw. The use of PEG with a specific number, for example, "PEG 400", indicates that that PEG having a weight average molecular weight of about 400. PEGs suitable for the present disclosure can have a weight average molecular weight ranging, for example, from about 200 to about 4000. Suitable PEGs can have a weight average molecular weight of, for example, about 200, about 300, about 400, about 500, about 600, about 700, about 800, about 900, about 1000, about 1100, about 1200, about 1300, about 1400, about 1500, about 1600, about 1700, about 1800, about 1900, about 2000, about 2100, about 2200, about 2300, about 2400, about 2500, or about 2600, about 2700, about 2800, about 2900, about 3000, about 3100, about 3200, about 3300, about 3400, about 3500, about 3600, about 3700, about 3800, about 3900, about 4000, or blends thereof. In some embodiments, the PEGs are selected from a group consisting of PEG 200, PEG 300, PEG 400, PEG 1000, PEG 1500, PEG 2000, PEG 2500, PEG 3350, PEG 4000, and a mixture thereof. In some embodiments, the wash compositions of the present disclosure may contain 1% to about 30% of one or more PEGs, preferably from about 2% to about 20%, more preferably from about 4% to about 18%, and most preferably from about 6% to about 12%, by weight of the entire formulation. In other embodiments, the wash compositions may contain no or substantially no PEG.

Examples of glycol ethers suitable for use in the present disclosure include, but not limited to, ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether. In some embodiments, the wash compositions of the present disclosure may contain 1% to about 30% of one or more glycol ethers, preferably from about 2% to about 20%, more preferably from about 4% to about 18%, and most preferably from about 6% to about 12%, by weight of the entire formulation. In some embodiments, the wash compositions of the present disclosure may have no or substantially no glycol ethers.

In some embodiments, the solvent system includes EO/PO block polymers, such as those marketed under the tradename Pluronic. These materials are formed by adding blocks of ethylene oxide moieties to the ends of polypropylene glycol chains to adjust the active surface properties of the resulting block polymers. In some embodiments, the wash compositions of the present disclosure may contain about 1% to about 30% of one or more EO/PO block copolymers, preferably from about 2% to about 10%, and more preferably from about 4% to about 6% by weight of the entire formulation. In some embodiments, molecular weight of the EO/PO block copolymer is less than 3500, with the EO portion at least 60% of the EO/PO molecule, preferably greater than 70%, and most preferably greater than 80%. In some embodiments, the wash compositions of the present disclosure may have no or substantially no EO/PO block copolymers.

In some embodiments, the solvent system includes ionic liquids. The ionic liquid may include anion and cation combinations having the formulas (I, II):

Formula (I)

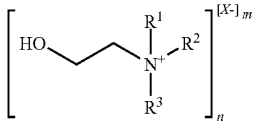

Formula (II)

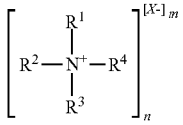

wherein $R^1$-$R^4$ are chosen from linear or branched, substituted or unsubstituted, alkyl, aryl, alkoxyalkyl, alkylenearyl hydroxyalkyl, or haloalkyl; wherein X is an anion such as those described hereinabove; wherein m and n are chosen to provide electronic neutrality; and wherein the ionic liquids are water immiscible when at least one of $R^1$-$R^4$ is $C_{12}$ or higher; or at least two of $R^1$-$R^4$ are $C_{10}$ or higher; or at least three of $R^1$-$R^4$ are $C_6$ or higher. In some embodiments, the wash compositions of the present disclosure may contain from about 1% to about 30% one or more ionic liquids, preferably from about 2% to about 20%, more preferably from about 4% to about 18%, and most preferably from about 6% to about 12%, by weight of the entire formulation. In some embodiments, the wash compositions of the present disclosure may have no or substantially no ionic liquids.

In some embodiment, the solvent system includes a water-binding saccharide. For example, the water-binding saccharide may be selected from fructose, glucose, sucrose, xylitol, sorbitol, mannitol, erythritol, dulcitol, inositol, adonitol, tagatose, trehalose, galactose, rhamnose, cyclodextrin, maltodextrin, dextran, sucrose, glucose, ribulose, fructose, threose, arabinose, xylose, lyxose, allose, altrose, mannose, idose, lactose, maltose, invert sugar, isotrehalose, neotrehalose, palatinose or isomaltulose, erythrose, deoxyribose, gulose, idose, talose, erythrulose, xylulose, psicose, turanose, cellobiose, amylopectin, glucosamine, mannosamine, fucose, glucuronic acid, gluconic acid, glucono-lactone, abequose, galactosamine, beet oligosaccharides, isomalto-oligosaccharides, xylo-oligosaccharides, gentio-oligoscaccharides, sorbose, nigero-oligosaccharides, palatinose oligosaccharides, fucose, fractooligosaccharides, maltotetraol, maltotriol, malto-oligosaccharides, lactulose, melibiose, raffinose, rhamnose, ribose, coupling sugars, soybean oligosaccharides, or glucose syrup, high fructose corn/starch syrup (HFCS), and a mixture thereof. HFCS typically refers to a blend of approximately 23% water and 77% saccharide. For example, HFCS 55 typically refers to a blend of water (about 23%), glucose (about 34%), and fructose (about 42%). However, in a dried form, HFCS 55 contains approximately 55% fructose by weight of dry HFCS. Unless otherwise stated, HFCS used herein refers to a wet blend which contains water, as it is supplied from HFCS manufacturers. However, it should be understood that dry or essentially dry hybrid of monosaccharides (e.g., HFCS), wherein water has been removed partially or completely, can also be used.

Total water content in the wash composition is the sum of added water (i.e., 100% or substantially 100% water) and water contained in other ingredients of the wash composition. In some embodiments, the wash composition includes from about 5% to about 35%, preferably from about 7.5% to about 30%, more preferably from about 10% to about 25%, and even more preferably from about 15% to about 20% of total water, based on the total weight of the wash composition. In some embodiments, there is less water than non-aqueous solvents by weight. In other embodiments, the weight ratio of water to non-aqueous solvents is from about 3:1 to about 1:3, preferably about 2:1 to about 1:2.

As noted above, in some embodiments, one or more beneficial compositions may optionally be added to and included in the wash composition, including but not limited to enzymes, peroxy compounds, bleach activators, anti-redeposition agents, neutralizers, optical brighteners, foam inhibitors, chelators, buttering agents, dye transfer inhibitors, soil release agents, water softeners, and other components. In further embodiments, additional beneficial compositions include electrolytes, pH regulators, graying inhibitors, anti-crease components, bleach agents, colorants, scents, processing aids, antimicrobial agents, and preservatives. Combinations of any of the foregoing may be used in a wash composition.

Possible enzymes that may be in the wash composition contemplated herein include one or more of a protease, lipase, cutinase, amylase, carbohydrase, cellulase, pectinase, mannanase, arabinase, galactanase, xylanase, oxidase, (e.g., a laccase), and/or peroxidase, but others are also possible. In general, the properties of the selected enzyme(s) should be compatible with the selected wash composition, (i.e., pH-optimum, compatibility with other enzymatic and non-enzymatic ingredients, etc.). The detergent enzyme(s) may be included in the wash composition by adding separate additives containing one or more enzymes, or by adding a combined additive including all the enzymes that are added to the wash composition. The enzyme(s) should be present in the wash composition in effective amounts, such as from about 0 weight percent to about 5 weight percent of enzyme, or from about 0.001 to about 1 weight percent, or from about 0.2 to about 2 weight percent, or from about 0.5 to about 1 weight percent, based on the total weight of the wash composition, in various embodiments.

As alluded to above, a peroxy compound may optionally be present in the wash composition. Exemplary peroxy compounds include organic peracids or peracidic salts of organic acids, such as phthalimidopercaproic acid, perbenzoic acid or salts of diperdodecanedioic acid, hydrogen peroxide and inorganic salts that release hydrogen peroxide under the washing conditions, such as perborate, percarbonate and/or persilicate. Hydrogen peroxide may also be produced with the assistance of an enzymatic system, i.e. an oxidase and its substrate. Other possible peroxy compounds include alkali metal percarbonates, alkali metal perborate monohydrates, alkali metal perborate tetrahydrates or hydrogen peroxide. Peroxy compounds may be present in the wash composition at an amount of from about 0 to about 50 weight percent, or an amount of from about 3 to about 30 weight percent, or an amount of from about 3 to about 10 weight percent, based on the total weight of the wash composition, in various embodiments.

Bleach activators may optionally be added and included in the wash composition. Conventional bleach activators that form peroxycarboxylic acid or peroxyimidic acids under perhydrolysis conditions and/or conventional bleach-activating transition metal complexes may be used. The bleach activator optionally present may include, but is not limited to, one or more of: N- or O-acyl compounds, for example polyacylated alkylenediamines, such as tetraacetylethylenediamine; acylated glycolurils, such as tetraacetylglycoluril; N-acylated hydantoins; hydrazides; triazoles; urazoles; diketopiperazines; sulfurylamides and cyanurates; carboxylic anhydrides, such as phthalic anhydride; carboxylic acid esters, such as sodium isononanoylphenolsulfonate; acylated sugar derivatives, such as pentaacetyl glucose; and cationic nitrile derivatives such as trimethylammonium acetonitrile salts.

To avoid interaction with peroxy compounds during storage, the bleach activators may be coated with shell substances or granulated prior to addition to the wash composition, in a known manner. As such, the bleach activator and/or other components may be present in a liquid wash composition as a free or floating particulate. Exemplary embodiments of the coating or shell substance include tetraacetylethylenediamine granulated with the assistance of carboxymethylcellulose and having an average grain size of 0.01 mm to 0.8 mm, granulated 1,5-diacetyl-2,4-dioxohexahydro-1,3,5-triazine, and/or trialkylammonium acetonitrile formulated in particulate form. In alternative embodiments, the bleach activators may be enclosed in a compartment, separate from the compartment that contains peroxy compounds and/or other compounds of the wash composition. In various embodiments, the bleach activators may be present in the wash composition in quantities of from about 0 to about 8 weight percent, or from about 0 to about 6 weight percent, or from about 0 to about 4 weight percent, in each case relative to the total weight of the wash composition.

One or more anti-redeposition agents may also be optionally included in the wash composition. Anti-redeposition agents include polymers with a soil detachment capacity, which are also known as "soil repellents" due to their ability to provide a soil-repelling finish on the treated surface, such as a fiber. Anti-redeposition agents include polymers with a soil detachment capacity. One example in regard to polyesters includes copolyesters prepared from dicarboxylic acids, such as adipic acid, phthalic acid or terephthalic acid. In an exemplary embodiment, an anti-redeposition agents includes polyesters with a soil detachment capacity that include those compounds which, in formal terms, are obtainable by esterifying two monomer moieties, the first monomer being a dicarboxylic acid HOOC-Ph-COOH and the second monomer a diol HO—(CHR$^{11}$-)aOH, which may also be present as a polymeric diol H—(O—(CHR$^{11}$—)$_a$)$_b$OH. Ph here means an ortho-, meta- or para-phenylene residue that may bear 1 to 4 substituents selected from alkyl residues with 1 to 22 C atoms, sulfonic acid groups, carboxyl groups and mixtures thereof. R$^{11}$ means hydrogen or an alkyl residue with 1 to 22 C atoms and mixtures thereof "a" means a number from 2 to 6 and "b" means a number from 1 to 300. The polyesters obtainable therefrom may contain not only monomer diol units —O—(CHR$^{11}$—)$_a$O— but also polymer diol units —(O—(CHR$^{11}$—)$_a$)$_b$O—. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The average molecular weight of the polyesters with a soil detachment capacity may be in the range of from about 250 to about 100,000, or from about 500 to about 50,000 in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the anti-redeposition agent) may include small proportions, such as no more than about 10 mole percent relative to the proportion of Ph with the above-stated meaning, of other acids that include at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols HO—(CHR$^{11}$—)$_a$OH include those in which R$^{11}$ is hydrogen and "a" is a number of from about 2 to about 6, and in another embodiment includes those in which "a" has the value of 2 and R$^{11}$ is selected from hydrogen and alkyl residues with 1 to 10 C atoms, or where R$^{11}$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with an average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, benzoic acid, which may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, the hydrogenation product thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives. The anti-redeposition agent is present in the wash composition at an amount of from about 0 to about 3 weight percent, or an amount of from about 0 to about 2 weight percent, or an amount of from about 0 to about 1 weight percent, based on the total weight of the wash composition, in various embodiments.

Neutralizers are optionally added to and included in the wash composition. Exemplary neutralizers include, but are not limited to, sodium hydroxide, triethanol amine, monoethanol amine, buffers, or other compounds that adjusts the pH of the wash composition. Neutralizers may be present in the wash composition at an amount of from about 0 to about 5 weight percent in some embodiments, based on the total weight of the wash composition, but in other embodiments the neutralizer may be present in the wash composition at an amount of from about 0 to about 3 weight percent, or an amount of from about 0 to about 2 weight percent, based on the total weight of the wash composition.

Optical brighteners may optionally be included in the wash composition. Optical brighteners adsorb ultraviolet and/or violet light and re-transmit it as visible light, typically a visible blue light. Optical brighteners include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl) diphenyl. Mixtures of the above-stated optical brighteners may also be used. Optical brighteners may be present in the wash composition at an amount of from about 0 to about 1 weight percent in some embodiments, but in other embodiments optical brighteners are present in an amount of from about 0.01 to about 0.5 weight percent, or an amount of from about 0.05 to about 0.3 weight percent, or an amount of from 0.005 to about 5 weight percent, based on the total weight of the wash composition.

Foam inhibitors may also optionally be included in the wash composition. Suitable foam inhibitors include, but are not limited to, soaps of natural or synthetic origin, which include an elevated proportion of $C_{18}$-$C_{24}$ fatty acids. Suitable non-surfactant foam inhibitors are, for example, organopolysiloxanes and mixtures thereof with microfine, optionally silanized silica as well as paraffins, waxes, microcrystalline waxes and mixtures thereof with silanized silica or bis-fatty acid alkylenediamides. Mixtures of different foam inhibitors may also be used, for example mixtures of silicones, paraffins or waxes. In an exemplary embodiment, mixtures of paraffins and bistearylethylenediamide may be used. The wash composition may include the foam inhibitor at an amount of from about 0 to about 5 weight percent, but in other embodiments the foam inhibitor may be present at an amount of from about 0.05 to about 3 weight percent, or an amount of from about 0.5 to about 2 weight percent, based on the total weight of the wash composition.

Chelators bind and remove calcium, magnesium, or other metals from water, and may optionally be included in the wash composition. Many compounds can be used as water softeners, including but not limited to ethylenediaminetetraacetic acid (EDTA), nitrilotriacetic acid, diethylenetriaminepenta(methylenephosphonic acid), nitrilotris(methylenephosphonic acid), 1-hydroxyethane-1,1-diphosphonic acid, iminodisuccinic acid (IDS), or other chelating agents. Chelators may be present in the wash composition at an amount of from about 0 to about 5 weight percent in an exemplary embodiment, but in alternate embodiments the chelators are present at an amount of from about 0.01 to about 3 weight percent or an amount of from about 0.02 to about 1 weight percent, based on the total weight of the wash composition.

Bittering agents may optionally be added to hinder accidental ingestion of the single dose pack or the wash composition. Bittering agents are compositions that taste bad, so children or others are discouraged from accidental ingestion. Exemplary buttering agents include denatonium benzoate, aloin, and others. Bittering agents may be present in the wash composition at an amount of from about 0 to about 1 weight percent, or an amount of from about 0 to about 0.5 weight percent, or an amount of from about 0 to about 0.1 weight percent in various embodiments, based on the total weight of the wash composition.

The fabrics and/or garments subjected to a washing, cleaning or textile care processes contemplated herein may be conventional washable laundry, such as household laundry. In some embodiments, the major part of the laundry is garments and fabrics, including but not limited to knits, woven fabrics, denims, non-woven fabrics, felts, yarns, and toweling. The fabrics may be cellulose based such as natural cellulosics, including cotton, flax, linen, jute, ramie, sisal or coir or manmade cellulosics (e.g., originating from wood pulp) including viscose/rayon, ramie, cellulose acetate fibers (tricell), lyocell or blends thereof. The fabrics may also be non-cellulose based such as natural polyamides including wool, camel, cashmere, mohair, rabbit, and silk, or the fabric may be a synthetic polymer such as nylon, aramid, polyester, acrylic, polypropylene and spandex/elastin, or blends of any of the above-mentioned products. Examples of blends are blends of cotton and/or rayon/viscose with one or more companion material such as wool, synthetic fibers (e.g., polyamide fibers, acrylic fibers, polyester fibers, polyvinyl alcohol fibers, polyvinyl chloride fibers, polyurethane fibers, polyurea fibers, aramid fibers), and cellulose-containing fibers (e.g., rayon/viscose, ramie, flax, linen, jute, cellulose acetate fibers, lyocell).

In one embodiment, the fabrics and/or garments are added to a washing machine, and the single dose pack or heavy-duty liquid including the wash composition of the present disclosure is also added to the washing machine before wash water is added. In an alternate embodiment, the single dose pack or heavy-duty liquid may be added to an automatic detergent addition system of a washing machine, where the contents of the single dose pack or heavy-duty liquid are added to the wash water with the fabrics and/or garments after the washing process has begun. In yet another embodiment, the single dose pack or heavy-duty liquid is manually added to the fabrics and/or garments with the wash water after the washing process has started. The wash composition added to the water in the washing machine is referred to as a wash liquor. The fabrics and/or garments are laundered (agitated) with the wash water and the contents of the single dose pack or heavy-duty liquid (i.e., the wash liquor). The fabrics and/or garments may then be dried (for example in a drying machine) and otherwise processed as normal.

ILLUSTRATIVE EXAMPLES

The present disclosure is now illustrated by the following non-limiting examples. It should be noted that various changes and modifications can be applied to the following examples and processes without departing from the scope of this disclosure, which is defined in the appended claims. Therefore, it should be noted that the following examples should be interpreted as illustrative only and not limiting in any sense.

As shown in Table 1, unit dose compositions were prepared by incorporating a surfactant system, a solvent system, beneficial compositions, and other materials commonly used in a finished product. The values shown in Table 1 represent the weight percent of each component, based on the total weight of the respective wash compositions. As shown in Table 1, four comparative examples were prepared; additionally, three inventive examples were prepared, which include the synergistic surfactant system of the present disclosure, namely LAS combined with MEE, but with the inclusion of AE and AES as well, which as noted above is optional.

TABLE 1

| Component | Comparative Ex. 1 | Comparative Ex. 2 | Comparative Ex. 3 | Comparative Ex. 4 |
|---|---|---|---|---|
| C12-C15 Alcohol Ethoxylate (AE) 7EO | 23.074 | 23.074 | 23.074 | 23.074 |
| Sodium C12-C14 Alcohol Ethoxysulfate (AES) 3EO (60% Active) | 22.3 | 22.3 | 22.3 | 22.3 |
| Linear AlkylBenzene Sulfonate (LAS) | 5 | 0 | 15 | 0 |
| C18 Methyl Ester Ethoxylate 10EO | 0 | 15 | 0 | 5 |
| Non-Aqueous Solvent | 29.65 | 19.95 | 18.1 | 29.95 |
| Water | 9 | 9 | 9 | 9 |
| Coconut Fatty Acid, Neutralizers, Bittering Agent, Chelators, Enzymes, Polymers, Optical Brighteners, Dye, Fragrance | 10.976 | 10.676 | 12.526 | 10.676 |
| Total | 100 | 100 | 100 | 100 |

TABLE 1-continued

| Component | Inventive Ex. 1 | Inventive Ex. 2 | Inventive Ex. 3 |
|---|---|---|---|
| C12-C15 Alcohol Ethoxylate (AE) 7EO | 23.074 | 23.074 | 23.074 |
| Sodium C12-C14 Alcohol Ethoxysulfate (AES) 3EO (60% Active) | 22.3 | 22.3 | 22.3 |
| Linear AlkylBenzene Sulfonate (LAS) | 5 | 10 | 5 |
| C18 Methyl Ester Ethoxylate 10EO | 10 | 5 | 5 |
| Non-Aqeuous Solvents | 19.65 | 18.6 | 24.65 |
| Water | 9 | 9 | 9 |
| Coconut Fatty Acid, Neutralizers, Bittering Agent, Chelators, Enzymes, Polymers, Optical Brighteners, Dye, Fragrance | 10.976 | 12.026 | 10.976 |
| Total | 100 | 100 | 100 |

Comparative Examples 1-4 and Inventive Examples 1-3 were tested for their cleaning performance. The wash test consisted of 2 washes in a traditional top-loaded washing machine at both 90° F. and 59° F. using eight stains (blood, chocolate ice-cream, coffee, dust sebum, grape juice, grass, BBQ sauce, and mud) in 120 ppm water on two different fabrics (knitted cotton (KC) and woven blend (WB)). Stain Removal Indexes (SRI) were collected following the procedure per the ASTM International standard, designated as D4265 (2014) "Standard Guide for Evaluating Stain Removal Performance in Home Laundering". The SRI values are listed in Table 2, with Comparative Example 1 showing the absolute SRI value, and the other Examples showing deviations from Comparative Example 1.

TABLE 2

| | | | SRI Value | SRI Value Deviation from Comparative Ex. 1 | | |
|---|---|---|---|---|---|---|
| Wash Temp. | Stain | Fabric | Comparative Ex. 1 | Comparative Ex. 2 | Comparative Ex. 3 | Comparative Ex. 4 |
| 59° F. | Blood | KC | 85.75 | 1.3 | 0.63 | 1.46 |
| | | WB | 93.56 | 0.17 | 0.11 | 0.12 |
| | Choc. | KC | 83.01 | 0.7 | 0.65 | 0.4 |
| | Ice-Cream | WB | 93.24 | −0.02 | 0.11 | −0.14 |
| | Coffee | KC | 84.04 | −0.2 | 0.28 | 0.39 |
| | | WB | 94.09 | 0.13 | 0.15 | 0.04 |
| | Dust Sebum | KC | 78.04 | 0.2 | 0.34 | 0.11 |
| | | WB | 87.38 | 0.12 | 0.39 | −0.02 |
| | Grape Juice | KC | 82.83 | 0.09 | 0.49 | −0.02 |
| | | WB | 93.71 | 0.21 | 0.17 | 0.09 |
| | Grass | KC | 66.38 | −1.2 | 0.23 | −0.86 |
| | | WB | 78.01 | −1.45 | 0.77 | −0.92 |

TABLE 2-continued

| | | | | | | |
|---|---|---|---|---|---|---|
| | BBQ Sauce | KC | 93.61 | −0.64 | 0.22 | −0.23 |
| | | WB | 93 | −0.02 | 0.04 | −0.07 |
| | Mud | KC | 74.9 | 0.1 | −0.46 | 0.23 |
| | | WB | 90.97 | 0.14 | 0.2 | 0.29 |
| 90° F. | Blood | KC | 88.75 | 1.31 | −0.25 | 0.8 |
| | | WB | 93.72 | 0.01 | −0.14 | 0.025 |
| | Choc. | KC | 86.58 | 0.54 | 1.15 | 0.73 |
| | Ice-Cream | WB | 94.16 | 0.05 | 0.28 | 0.21 |
| | Coffee | KC | 87.49 | −0.08 | 0.11 | 0.07 |
| | | WB | 94.63 | 0.22 | −0.01 | −0.03 |
| | Dust Sebum | KC | 81.44 | −0.17 | 0.74 | −0.09 |
| | | WB | 87.12 | 0.52 | 0.21 | 0.36 |
| | Grape Juice | KC | 87.35 | −0.03 | 0.03 | −0.28 |
| | | WB | 94.78 | 0 | −0.18 | −0.17 |
| | | KC | 66.85 | 0.09 | −0.2 | −0.96 |
| | Grass | WB | 78.44 | −0.5 | 0.55 | −0.57 |
| | BBQ Sauce | KC | 95.86 | −0.1 | 0.19 | −0.08 |
| | | WB | 96.18 | −0.11 | 0.09 | 0.02 |
| | | KC | 75.74 | 0.17 | 0.71 | 0.3 |
| | Mud | WB | 91.47 | −0.05 | −0.2 | −0.13 |

| | | | SRI Value | SRI Value Deviation from Comparative Ex. 1 | | |
|---|---|---|---|---|---|---|
| Wash Temp. | Stain | Fabric | Comparative Ex. 1 | Inventive Ex. 1 | Inventive Ex. 2 | Inventive Ex. 3 |
| 59° F. | Blood | KC | 85.75 | 0.7 | 0.8 | 1.98 |
| | | WB | 93.56 | 0.74 | 0.57 | 0.3 |
| | Choc. | KC | 83.01 | 1.15 | −0.01 | −0.02 |
| | Ice-Cream | WB | 93.24 | 0.1 | 0.13 | 0.06 |
| | Coffee | KC | 84.04 | 0.5 | −0.14 | 0.99 |
| | | WB | 94.09 | 0.2 | −0.03 | 0.04 |
| | Dust Sebum | KC | 78.04 | 1.5 | 0.89 | 0.84 |
| | | WB | 87.38 | 1.04 | 0.27 | 0.39 |
| | Grape Juice | KC | 82.83 | −0.32 | 0.09 | 0.43 |
| | | WB | 93.71 | 0.23 | −0.09 | 0.17 |
| | Grass | KC | 66.38 | 0.88 | 1.55 | 0.35 |
| | | WB | 78.01 | 0.98 | 0.6 | 0.61 |
| | BBQ Sauce | KC | 93.61 | −0.13 | −0.04 | 0.21 |
| | | WB | 93 | 0.04 | −0.05 | −0.15 |
| | Mud | KC | 74.9 | 0.19 | −0.2 | −0.28 |
| | | WB | 90.97 | 0.33 | 0.25 | 0.27 |
| 90° F. | Blood | KC | 88.75 | 0.92 | 0.52 | 0.88 |
| | | WB | 93.72 | 0.51 | 0.36 | 0.48 |
| | Choc. | KC | 86.58 | 0.77 | 0.66 | 1.21 |
| | Ice-Cream | WB | 94.16 | 0.11 | −0.07 | 0.25 |
| | Coffee | KC | 87.49 | −0.31 | 0.36 | 0.3 |
| | | WB | 94.63 | 0.03 | −0.1 | 0.09 |
| | Dust Sebum | KC | 81.44 | 1 | 1.15 | 0.38 |
| | | WB | 87.12 | 1.08 | 0.09 | 0.78 |
| | Grape Juice | KC | 87.35 | 0 | −0.19 | 0.05 |
| | | WB | 94.78 | 0 | −0.28 | −0.27 |
| | Grass | KC | 66.85 | 1.34 | 1.03 | 0.5 |
| | | WB | 78.44 | 1.05 | 0.47 | 0.42 |
| | BBQ Sauce | KC | 95.86 | 0.06 | 0.3 | 0.29 |
| | | WB | 96.18 | 0.01 | −0.03 | 0.09 |
| | Mud | KC | 75.74 | 0.63 | 0.33 | 0.48 |
| | | WB | 91.47 | −0.12 | −0.27 | 0.09 |

Based on the SRI data presented in Table 2, a ranking analysis was performed for each Example wash composition. The analysis counts the number of SRI value improvements over all other samples in the test. Thus, negative counts indicate the wash composition performed more poorly than other samples in the test overall, while positive counts indicate the wash composition performed better than other samples in the test overall. The results of this analysis are presented in Table 3. As can be seen in Table 3, each of the Inventive Examples 1-3 achieved significantly more positive counts than any of the Comparative Examples, which indicates that the surfactant systems in accordance with the present disclosure exhibit a synergy with respect to cleaning efficiency.

TABLE 3

| | 90° F. Count | 59° F. Count |
|---|---|---|
| Comparative Ex. 1 | 0 | 0 |
| Comparative Ex. 2 | 4 | −4 |
| Comparative Ex. 3 | 5 | 6 |
| Comparative Ex. 4 | 1 | 3 |
| Inventive Ex. 1 | 12 | 16 |
| Inventive Ex. 2 | 4 | 11 |
| Inventive Ex. 3 | 11 | 14 |

As previously discussed in this disclosure, the detergent compositions may be provided in the form of a heavy-duty liquid. Table 4, below, illustrates two exemplary 12.5% by weight active surfactant heavy-duty liquid detergent compositions in accordance with the present disclosure, along with a comparative example (all values being weight percent). Furthermore, Table 5, below, illustrates two exemplary 25% by weight active surfactant heavy-duty liquid detergent compositions in accordance with the present disclosure, along with a comparative example (all values being weight percent).

TABLE 4

| Component | Comparative Ex. 5 | Inventive Ex. 4 | Inventive Ex. 5 |
|---|---|---|---|
| Water | 79.295 | 79.295 | 76.795 |
| C12-C15 Alcohol Ethoxylate (AE) 7EO | 5.75 | 5.75 | 5.75 |
| Sodium C12-C14 Alcohol Ethoxysulfate (AES) 3EO (60% Active) | 6.5 | 6.5 | 6.5 |
| Linear AlkylBenzene Sulfonate (LAS) | 2.5 | 1.25 | 2.5 |
| C18 Methyl Ester Ethoxylate 10EO | 0 | 1.25 | 2.5 |
| Non-aqueous Solvent | 2.5 | 2.5 | 2.5 |
| Fragrance, Chelator, Preservative, Enzyme, Polymers, Optical Brightener, Coconut Fatty Acid, Neutralizers | 3.455 | 3.455 | 3.455 |
| Total | 100 | 100 | 100 |

TABLE 5

| Component | Comparative Ex. 6 | Inventive Ex. 6 | Inventive Ex. 7 |
|---|---|---|---|
| Water | 58.59 | 58.59 | 53.59 |
| C12-C15 Alcohol Ethoxylate (AE) 7EO | 11.5 | 11.5 | 11.5 |
| Sodium C12-C14 Alcohol Ethoxysulfate (AES) 3EO (60% Active) | 13 | 13 | 13 |
| Linear AlkylBenzene Sulfonate (LAS) | 5 | 2.5 | 5 |
| C18 Methyl Ester Ethoxylate 10EO | | 2.5 | 5 |
| Non-aqueous Solvent | 5 | 5 | 5 |
| Fragrance, Chelator, Preservative, Enzyme, Polymers, Optical Brightener, Coconut Fatty Acid, Neutralizers | 6.91 | 6.91 | 6.91 |
| Total | 100 | 100 | 100 |

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A unit dose pack comprising a wash composition and a container composed of a water-soluble film, wherein the wash composition is enclosed in the container, and wherein the wash composition comprises:

(1) a surfactant system, wherein the surfactant system comprises:

a) an alkyl ether sulfate (AES) comprising sodium lauryl ether sulfate (SLES), wherein the alkyl ether sulfate is present in an amount of about 13 wt % to about 14 wt % actives, based on the total weight of the wash composition, b) a nonionic alcohol ethoxylate (AE) comprising a compound according to Formula (B):

$$R_2—(—O—C_2H_4—)_m—OH$$

(B) wherein $R_2$ is a hydrocarbyl group having 8 to 16 carbon atoms and m is from 1 to 20, wherein the nonionic alcohol ethoxylate is present in an amount of about 23 wt % actives, based on the total weight of the wash composition, c) a linear alkylbenzenesulfonate (LAS) comprising an alkali metal salt of a $C_{10}$-$C_{16}$ alkyl benzene sulfonic acid, wherein the linear alkylbenzenesulfonate is present in an amount of about 5 wt % to about 10 wt % actives, based on the total weight of the wash composition, and d) a fatty acid methyl ester ethoxylate (MEE) that has an average unit number of repeating ethylene oxide (EO) units of from about 5 to 30 moles, and wherein the fatty acid methyl ester ethoxylate is derived from a fatty acid having from 10 to 22 carbons, and wherein the fatty acid methyl ester ethoxylate is present in an amount of about$_5$ wt % to about 10 wt % actives, based on the total weight of the wash composition, (2) a solvent system, wherein the solvent system comprises a non-aqueous solvent present in an amount of from about 18 to about 25 weight percent based on a total weight of the wash composition and wherein the non-aqueous solvent is chosen from polyols, ionic liquids, glycol ethers, ethylene oxide/propylene oxide (EO/PO) block copolymers, polyethylene glycol, and combinations thereof;

water present in an amount of from about 14.5 to about 16 weight percent based on a total weight of the wash composition; and one or more beneficial compositions.

2. The wash composition of claim 1, wherein the one or more beneficial compositions are selected from the group consisting of: an enzyme, a peroxy compound, a bleach activator, an anti-redeposition agent, a neutralizer, an optical brightener, a foam inhibitor, a chelator, a bittering agent, a dye transfer inhibitor, a soil release agent, a water softener, an electrolyte, a pH regulator, a graying inhibitor, an anti-crease component, a bleach agent, a colorant, a scent, a processing aid, an antimicrobial agent, and a preservative.

3. The wash composition of claim 1 wherein the a) alkyl ether sulfate (AES) is the sodium lauryl ether sulfate (SLES).

4. The wash composition of claim 1 wherein the b) nonionic alcohol ethoxylate (AE) is the compound according to Formula (B).

5. The wash composition of claim 1 wherein the c) linear alkylbenzenesulfonate (LAS) is the alkali metal salt of the $C_{10}$-C16 alkyl benzene sulfonic acid.

6. The wash composition of claim 1 wherein the solvent system is the non-aqueous solvent.

7. The wash composition of claim 2 wherein the a) alkyl ether sulfate (AES) is the sodium lauryl ether sulfate (SLES).

8. The wash composition of claim 7 wherein the b) nonionic alcohol ethoxylate (AE) is the compound according to Formula (B).

9. The wash composition of claim 8 wherein the c) linear alkylbenzenesulfonate (LAS) is the alkali metal salt of the $C_{10}$-$C_{16}$ alkyl benzene sulfonic acid.

10. The wash composition of claim 9 wherein the solvent system is the non-aqueous solvent.

11. The wash composition of claim 1 wherein $R_2$ is from 12-15.

12. The wash composition of claim 11 wherein m is 7.

13. The wash composition of claim 12 wherein the sodium lauryl ether sulfate is ethoxylated with 3 moles of ethylene oxide.

14. The wash composition of claim 13 wherein the fatty acid methyl ester ethoxylate is a C18 methyl ester ethoxylated with 10 moles of ethylene oxide.

15. The wash composition of claim 1 wherein the sodium lauryl ether sulfate is ethoxylated with 3 moles of ethylene oxide.

16. The wash composition of claim 1 wherein the fatty acid methyl ester ethoxylate is a C18 methyl ester ethoxylated with 10 moles of ethylene oxide.

17. The wash composition of claim 1 wherein the a) alkyl ether sulfate (AES) is the sodium lauryl ether sulfate (SLES), the b) nonionic alcohol ethoxylate (AE) is the compound according to Formula (B), the c) linear alkylbenzenesulfonate (LAS) is the alkali metal salt of the $C_{10}$-$C_{16}$ alkyl benzene sulfonic acid, wherein $R_2$ is from 12-15, and m is 7.

18. The wash composition of claim 17 wherein the sodium lauryl ether sulfate is ethoxylated with 3 moles of ethylene oxide, and the fatty acid methyl ester ethoxylate is a C18 methyl ester ethoxylated with 10 moles of ethylene oxide.

19. A unit dose pack comprising a wash composition and a container composed of a water-soluble film, wherein the wash composition is enclosed in the container, and wherein the wash composition comprises:

(1) a surfactant system, wherein the surfactant system comprises:

a) sodium lauryl ether sulfate (SLES) present in an amount of about 13 wt % to about 14 wt % actives, based on the total weight of the wash composition, b) a compound according to Formula (B):

$$R_2—(—O—C_2H_4—)_m—OH \quad (B)$$

wherein $R_2$ is a hydrocarbyl group having 12 to 15 carbon atoms and m is 7, and is present in an amount of about 23 wt % actives, based on the total weight of the wash composition, c) an alkali metal salt of a $C_{10}$-$C_{16}$ alkyl benzene sulfonic acid present in an amount of about 5 wt % to about 10 wt % actives, based on the total weight of the wash composition, and d) a fatty acid methyl ester ethoxylate (MEE) that has an average unit number of repeating ethylene oxide (EO) units of from about 5 to 30 moles, wherein the fatty acid methyl ester ethoxylate is derived from a fatty acid having from 10 to 22 carbons, and wherein the fatty acid methyl ester ethoxylate is present in an amount of about 5 wt % to about 10 wt % actives, based on the total weight of the wash composition, (2) a solvent system, wherein the solvent system comprises a non-aqueous solvent present in an amount of from about 18 to about 25 weight percent based on a total weight of the wash composition and wherein the non-aqueous solvent is chosen from polyols, ionic liquids, glycol ethers, ethylene oxide/propylene oxide (EO/PO) block copolymers, polyethylene glycol, and combinations thereof;

water present in an amount of from about 14.5 to about 16 weight percent based on a total weight of the wash composition; and one or more beneficial compositions, wherein the sodium lauryl ether sulfate is ethoxylated with 3 moles of ethylene oxide, wherein the fatty acid methyl ester ethoxylate is a C18 methyl ester ethoxylated with 10 moles of ethylene oxide, and wherein the one or more beneficial compositions are selected from the group consisting of: an enzyme, a peroxy compound, a bleach activator, an anti-redeposition agent, a neutralizer, an optical brightener, a foam inhibitor, a chelator, a bittering agent, a dye transfer inhibitor, a soil release agent, a water softener, an electrolyte, a pH regulator, a graying inhibitor, an anti-crease component, a bleach agent, a colorant, a scent, a processing aid, an antimicrobial agent, and a preservative.

* * * * *